US010294014B2

(12) United States Patent
Corte Coi et al.

(10) Patent No.: US 10,294,014 B2
(45) Date of Patent: May 21, 2019

(54) PACKET FOR BAR-SHAPED ARTICLES

(71) Applicant: G.D S.p.A., Bologna (IT)

(72) Inventors: Giulia Corte Coi, Auronzo di Cadore (IT); Manuele Cucchi, Gambettola (IT); Roberto Polloni, Modigliana (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 0 days.

(21) Appl. No.: 15/576,516

(22) PCT Filed: Jul. 6, 2016

(86) PCT No.: PCT/IB2016/054042
§ 371 (c)(1),
(2) Date: Nov. 22, 2017

(87) PCT Pub. No.: WO2017/006257
PCT Pub. Date: Jan. 12, 2017

(65) Prior Publication Data

US 2018/0148249 A1 May 31, 2018

(30) Foreign Application Priority Data

Jul. 9, 2015 (IT) ..... 10201532232

(51) Int. Cl.
*B65D 85/10* (2006.01)

(52) U.S. Cl.
CPC ..... *B65D 85/1036* (2013.01); *B65D 85/1009* (2013.01)

(58) Field of Classification Search
CPC . B65D 85/1072; B65D 85/1036; A24F 15/12; A24F 15/20
USPC ..... 206/249, 250, 256, 257, 258, 261, 271, 206/272, 443, 784; 229/87.13, 87.14
See application file for complete search history.

(56) References Cited

U.S. PATENT DOCUMENTS 1,407,746 A 2/1922 Hagarty
1,453,585 A 5/1923 Giuffre et al.
2,512,207 A 6/1950 Isaac
(Continued)

OTHER PUBLICATIONS

International Search Report dated Sep. 7, 2016 for counterpart PCT Application No. PCT/IB2016/054042.

*Primary Examiner* — Jacob K Ackun
*Assistant Examiner* — Jenine Pagan
(74) *Attorney, Agent, or Firm* — Shuttleworth & Ingersoll, PLC; Timothy J. Klima

(57) ABSTRACT

A packet for bar-shaped articles including an outer wrapper defining an internal space for housing the bar-shaped articles and accessible through an access opening. The packet includes an internal drawer located inside the outer wrapper and a sleeve located inside the outer wrapper with an upper free edge accessible through the opening. The sleeve is configured to receive and support the evenly spaced bar-shaped articles with their longitudinal axes parallel to a longitudinal axis of the sleeve itself. The sleeve is wrapped round the outside of the internal drawer. The outer wrapper has at least one opening facing a sidewall of the sleeve at the internal drawer to allow applying at least one sliding force on the sleeve and to produce a rotation of the selfsame sleeve relative to the internal drawer and the outer wrapper.

13 Claims, 9 Drawing Sheets

(56) References Cited

U.S. PATENT DOCUMENTS

| | | | | | |
|---|---|---|---|---|---|
| 2,577,344 | A * | 12/1951 | Masure | A61J 7/0084 | 221/154 |
| 2,818,970 | A | 1/1958 | Pough | | |
| 2,819,814 | A * | 1/1958 | Hatch | A24F 15/005 | 221/121 |
| 3,159,272 | A * | 12/1964 | Swift | B65D 77/042 | 131/256 |
| 5,405,045 | A * | 4/1995 | Usmani | A24F 15/005 | 221/15 |
| 5,566,855 | A * | 10/1996 | Bradach | A24F 15/005 | 221/15 |
| 8,528,780 | B2 * | 9/2013 | Houghton | A24F 15/14 | 221/119 |
| 2016/0031634 | A1 * | 2/2016 | Hodges | B65D 5/708 | 206/213.1 |

* cited by examiner

PACKET FOR BAR-SHAPED ARTICLES

This application is the National Phase of International Application PCT/IB2016/054042 filed Jul. 6, 2016 which designated the U.S.

This application claims priority to Italian Patent Application No. 102015000032232 filed Jul. 9, 2015, which application is incorporated by reference herein.

TECHNICAL FIELD

This invention relates to a packet for shaped articles.

More specifically, this invention relates to a packet which can be used advantageously to house stick-shaped articles such as electronic cigarette refills and tobacco cigarettes, but is also very well suited to contain articles such as, for example, liquorice sticks or elongate chocolates.

BACKGROUND ART

In packets normally used to contain articles of this kind, the articles are usually arranged with their longitudinal axes parallel to each other and to a longitudinal direction of extension of the packets.

The upper end portion of a packet of this kind is normally provided with a lid covering the entire top end and which can be opened to expose the top ends of all the articles inside the packet so that a consumer can take them out. The lid must be relatively extensive because otherwise it would be very difficult, if not impossible, to see and take out the articles which are hidden from view.

This feature of prior art packets is, however, the reason for a major disadvantage because the large size of the lid makes it easier for all the articles to fall out of the packet if the lid accidentally opens (for example if a packet in a handbag or a garment pocket is jolted about).

Moreover, on account of the above described arrangement of the articles inside the packet, it is very likely that the articles remaining after a certain number of them have been taken out of the packet will lose their correct vertical position, making it more difficult to grip them to take them out. Indeed, in this situation, the articles no longer hold each other up in the correct position and, instead, tend to tip over and lie in a horizontal position inside the packet. When this happens, the articles are uncontrolled when the packet is moved and they tend to bump against each other and get damaged, making it relatively awkward for the consumer to take them out.

DISCLOSURE OF THE INVENTION

This invention has for an aim to provide a packet for bar-shaped articles which is free of the disadvantages described above with reference to packets of known type.

According to this invention, a packet for bar-shaped articles is provided which is made according to what is described in the appended claims.

BRIEF DESCRIPTION OF THE DRAWINGS

The invention is described below with reference to the accompanying drawings, which illustrate non-limiting embodiments of it, and in which.

DETAILED DESCRIPTION OF PREFERRED EMBODIMENTS OF THE INVENTION

Figure 1:
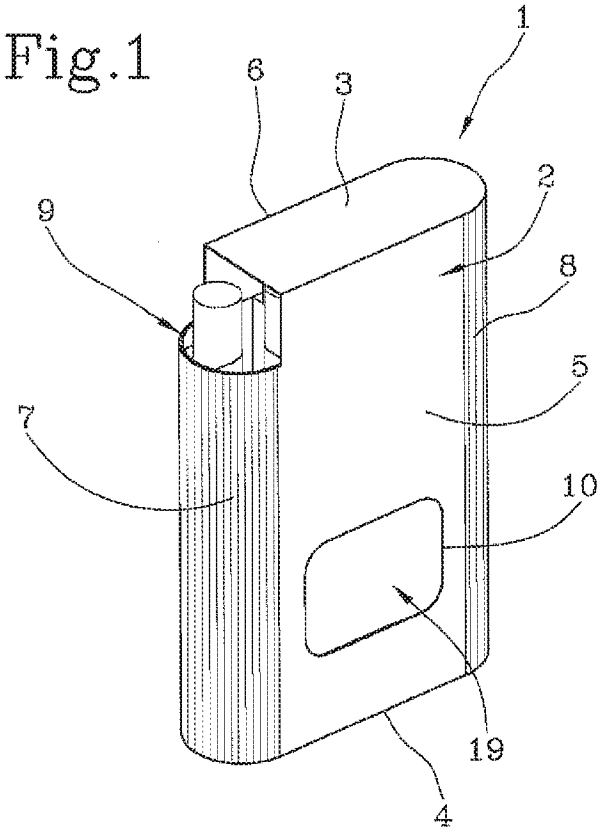

With reference to FIG. 1, the numeral 1 denotes in its entirety a packet for bar-shaped articles A consisting, for example, of articles of the tobacco industry, such as electronic cigarettes or cartridges of substances for emitting a spray in electronic cigarettes.

The packet 1 comprises an outer wrapper 2 made, for example, of paperboard or the like, and which is limited, at opposite axial ends of it, by a top wall 3 and a bottom wall 4, both having a substantially flattened oval shape. The outer wrapper 2 has a lateral surface defined by a longitudinal front band 5 and a longitudinal rear band 6, which are parallel to each other and substantially flat, and two longitudinal arcuate side bands 7, 8, which are opposite each other and which join the front band 5 and the rear band 6 to each other.

An axial end portion of the top wall 3 and of the arcuate side band 7 below it is cut away to form a top opening 9 giving access to the internal space and hence to the contents of the packet 1. Before the packet 1 is opened, the opening 9 may, if necessary, be closed, similarly to what is described below with reference to the packet 1' of FIG. 2, by a part of the top wall 3 and of the arcuate side band 7 below it, which are joined to the rest of the outer wrapper 2 by tearable lines of weakness that can be torn when the packet 1 is opened for the first time.

As shown in the accompanying drawing, the opening 9 covers a limited portion of the top wall 3 substantially corresponding to a single elongate article A. Preferably, the opening 9 is located at one corner of the packet 1 (along a short transverse top edge).

At respective laterally intermediate and mutually opposite zones situated in a bottom zone of the packet 1, the front and rear bands 5 and 6 have respective openings 10 and 11 which are substantially rectangular in shape and identical to each other.

More specifically, the outer wrapper 2 is defined by a box/package which has the shape of a parallelepiped or ellipsoid and which is provided with an opening 9, preferably openable by tearing, located for example in the top corner (near to where the top wall 3 meets the band 7 below it).

Figure 3:
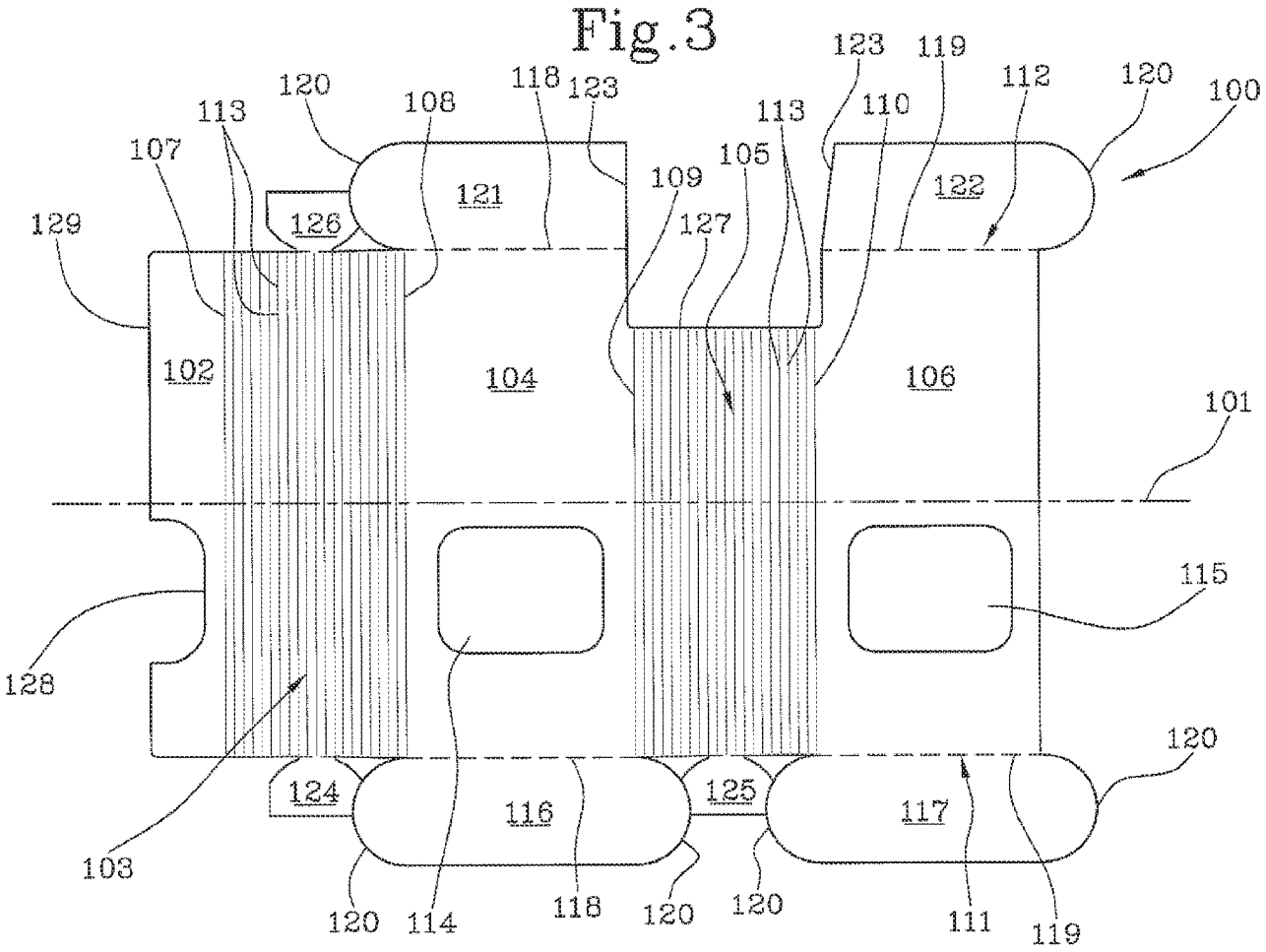
FIGS. 3 and 4 are plan views showing two blanks used to make the packet of FIG. 1.

As illustrated in FIG. 3, the outer wrapper 2 is made by folding a flat blank 100.

As illustrated in FIG. 3, the blank 100 has a substantially elongate, rectangular shape, extends along a longitudinal axis 101 and has five, substantially rectangular transverse walls, labelled 102, 103, 104, 105 and 106 from left to right in FIG. 3, joined to each other in pairs, from left to right, by lines which are perpendicular to the axis 101 and which are respectively labelled 107, 108, 109, and 110.

The blank 100 is also provided with two transverse folding lines of weakness, labelled 111 and 112, respectively, in a top and bottom zone of it in FIG. 3.

Along the walls 103 and 105 there are a plurality of lines of weakness 113 perpendicular to the axis 101 and running close to each other, whilst in the zones at the bottom of the walls 104 and 106 in FIG. 3, there are respective openings 114 and 115 which are substantially rectangular in shape and whose sides are parallel to the respective sides of the walls 104 and 106 themselves.

Two panels 116 and 117 having a substantially flattened oval shape are respectively connected to the portions of the line of weakness 111 which delimit the bottoms of the walls 104 and 106. The two panels 116 and 117 are connected to the walls 104 and 106, respectively, by straight stretches 118, 119 defining part of their perimeters, which are parallel to the axis 101 and which are joined to the ends of the free edges of the corresponding panels 116 and 117 in twos by respective arcuate stretches 120 without any breaks.

Each of the panels 116, 117 has respective arcuate stretches 120 protruding from both sides of the respective walls 104, 106, along the direction of the axis 101.

Two further panels 121 and 122 are respectively connected to the portions of the line of weakness 112 which delimit the tops of the walls 104 and 106. The shape of the panels 121 and 122 and their position relative to the line of weakness 112 substantially reflect the shape and position of the panels 116 and 117 relative to the line of weakness 111, except that the panels 121 and 122, above the wall 105, do not have the arcuate stretches 120 and are delimited at their facing portions by respective straight sides 123.

Alternated with the panels 116 and 117 there are respective tabs 124, 125 connected to the walls 103 and 105, respectively. A tab 126 is connected to the portion of the line of weakness 112 which delimits the top of the wall 103. In the direction perpendicular to the axis 101, the wall 105 is shorter than the wall 103 and extends between the line of weakness 111 and one side 127 located inside the area delimited by the lines of weakness 111 and 112.

On one side of it 129, perpendicular to the axis 101, the wall 102 has an indentation 128 which is similar in shape and size to a part of the opening 115.

In passing from the blank 100 to the outer wrapper 2, the wall 106 corresponds to the longitudinal front band 5 and the wall 104 corresponds to the longitudinal rear band 6. The openings 115 and 114 of the blank 100 thus define the openings 10 and 11 of the outer wrapper 2. The walls 103 and 105 define the two opposite longitudinal arcuate bands 7 and 8, respectively. The wall 102 is a connecting wall which, in the outer wrapper, is partly superposed on the wall 106.

The panels 116 and 117, in conjunction with the tabs 124 and 125, define the bottom wall 4 of the outer wrapper 2, while the panels 121 and 122, in conjunction with the tab 126, define the top wall 3 of the outer wrapper 2. The sides 123 and 127 define the edges of the upper opening 9 of the outer wrapper 2.

Figure 11:
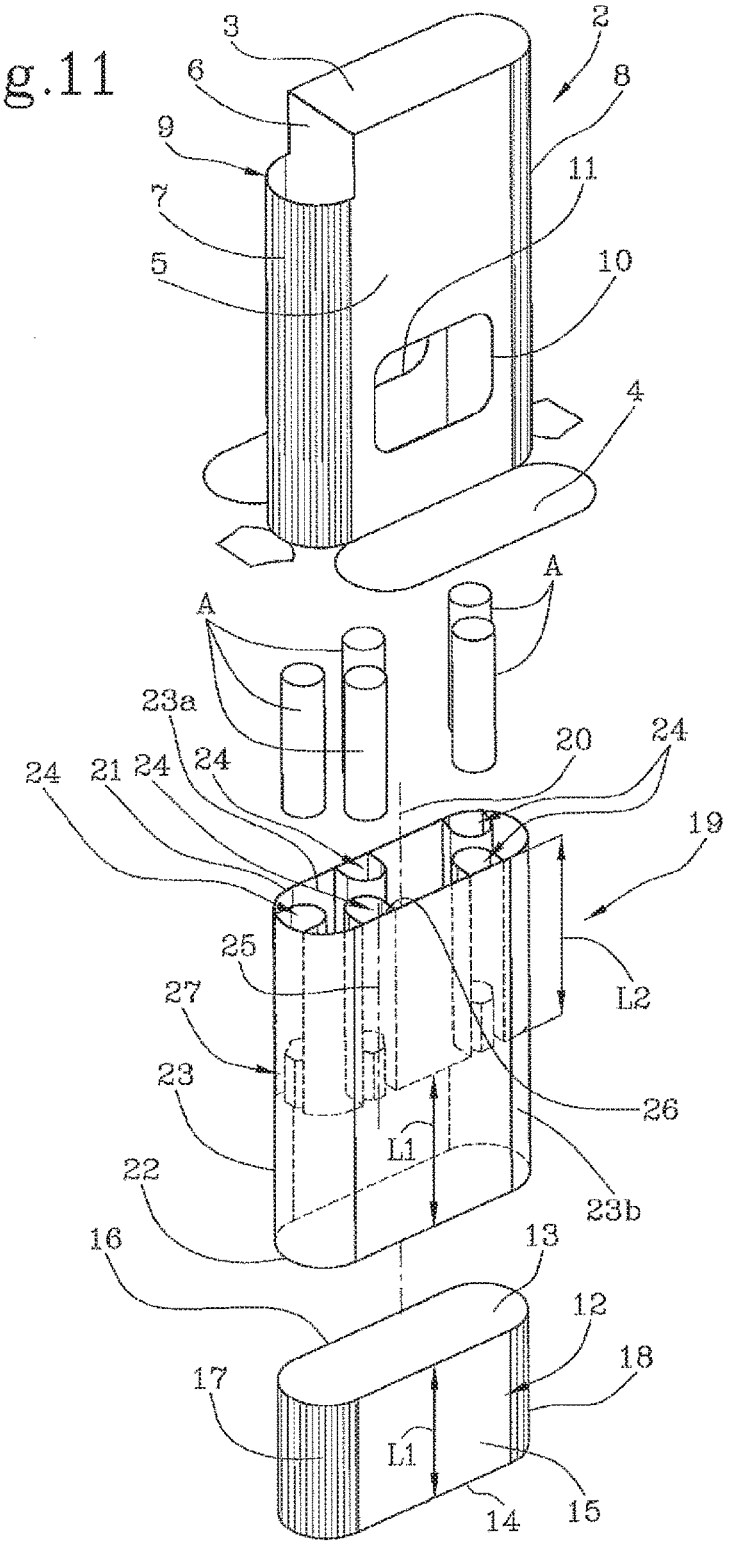
FIG. 11 is an exploded view of the packet of FIG. 1.

The packet 1 also comprises an internal drawer 12 located inside the outer wrapper 2. As illustrated in FIG. 11, the internal drawer 12 is made like a rigid package with rounded vertical edges, for example of paperboard or the like.

The internal drawer 12 is preferably limited, at the opposite axial ends of it, by a top wall 13 and a bottom wall 14, both having a substantially flattened oval shape. The internal drawer 12 has a lateral surface defined by a longitudinal front band 15 and a longitudinal rear band 16, which are parallel to each other and substantially flat, and two longitudinal arcuate side bands 17, 18, which are opposite each other and which join the front band 15 and the rear band 16 to each other. In possible alternative embodiments, the top wall 13 and the bottom wall 14 are absent or only the top wall 13 or the bottom wall 14 is present.

Figure 4:
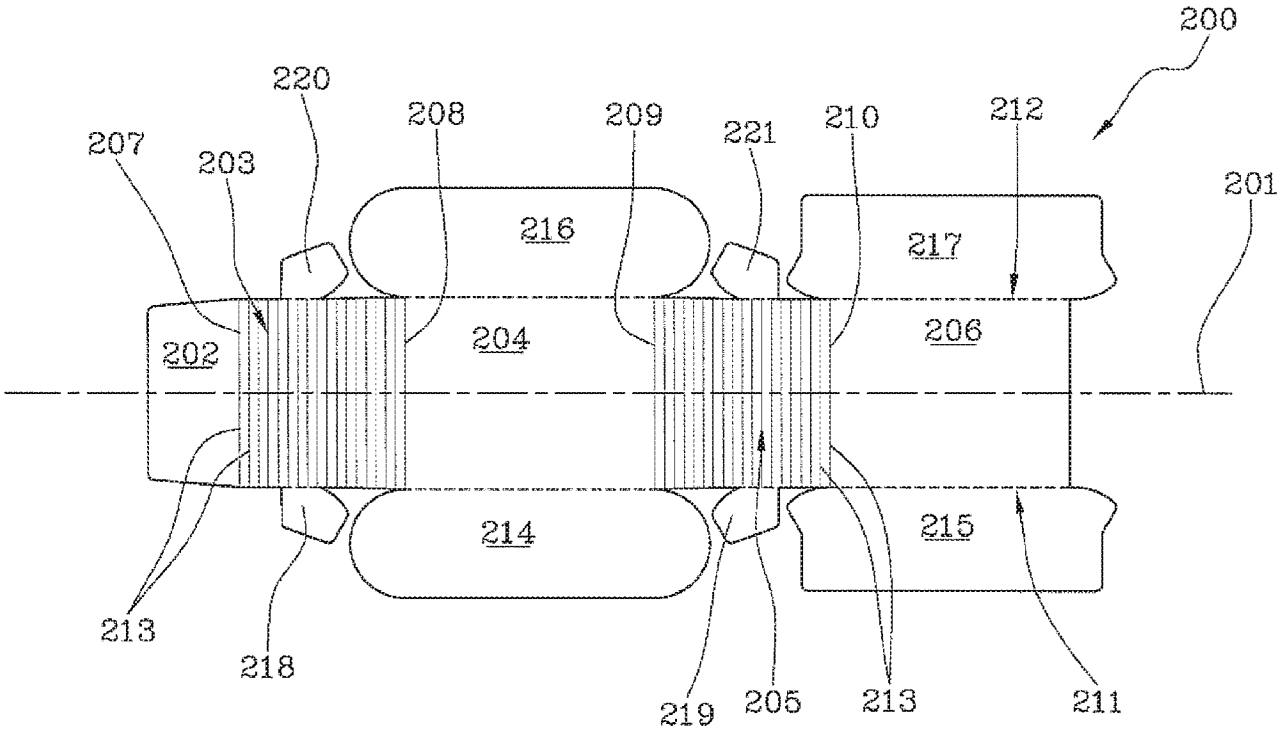

As illustrated in FIG. 4, the internal drawer 12 is made by folding a flat blank 200.

As illustrated in FIG. 4, the blank 200 has a substantially elongate, rectangular shape, extends along a longitudinal axis 201 and has five, substantially rectangular transverse walls, labelled 202, 203, 204, 205 and 206 from left to right in FIG. 4, joined to each other in pairs, from left to right, by lines which are perpendicular to the axis 201 and which are respectively labelled 207, 208, 209, and 210.

The blank 200 is also provided with two transverse folding lines of weakness, labelled 211 and 212, respectively, in a top and bottom zone of it in FIG. 4.

Along the walls 203 and 205 there are a plurality of lines of weakness 213 perpendicular to the axis 201 and running close to each other.

Two panels 214 and 215 are respectively connected to the portions of the line of weakness 211 which delimit the bottoms of the walls 204 and 206.

Two further panels 216 and 217 are respectively connected to the portions of the line of weakness 212 which delimit the tops of the walls 204 and 206. The shape of the panels 216 and 217 and their position relative to the line of weakness 212 substantially reflect the shape and position of the panels 214 and 215 relative to the line of weakness 211.

Alternated with the panels 214 and 215, 216 and 217, there are respective tabs 218, 219, 220 221. The tabs 218 and 220 are connected to the wall 203 at the lines of weakness 211 and 212, respectively. The tabs 219 and 221 are connected to the wall 205 at the lines of weakness 211 and 212, respectively.

In passing from the blank 200 to the internal drawer 12, the wall 206 corresponds to the longitudinal front band 15 and the wall 204 corresponds to the longitudinal rear band 16. The walls 203 and 205 define the two opposite longitudinal arcuate bands 17 and 18, respectively. The wall 202 is a connecting wall which, in the internal drawer, overlaps the wall 206.

The panels 216 and 217, in conjunction with the tabs 220 and 221, define the top wall 13 of the internal drawer 12, while the panels 214 and 215, in conjunction with the tabs 218 and 219, define the bottom wall 14 of the internal drawer 12.

The packet 1 also comprises a sleeve 19, located inside the outer wrapper 2 and configured to support the evenly spaced bar-shaped articles A with their longitudinal axes parallel to a longitudinal axis 20 of the sleeve 19 itself (FIG. 11). The sleeve 19 is also configured to move the bar-shaped articles A inside the outer wrapper 2 along a closed path configured to make at least one elongate article A accessible through the opening 9. More specifically, the closed path is positioned transversely to the longitudinal axis 20.

Inside the sleeve 19 there is at least one contact and guide element which, in the embodiments illustrated, comprises, and is defined by, the internal drawer 12. More specifically, the sleeve 19 is wrapped round the outside of the contact and guide element (the internal drawer 12).

Hereinafter, therefore, reference is made to the internal drawer 12 without thereby limiting the scope of the invention.

The sleeve 19 extends along the longitudinal axis 20 between a free upper edge 21 and a free lower edge 22. More specifically, the sleeve 19 receives and supports the evenly spaced bar-shaped articles A with their longitudinal axes parallel to the longitudinal axis 20 of the sleeve itself.

Figure 10:
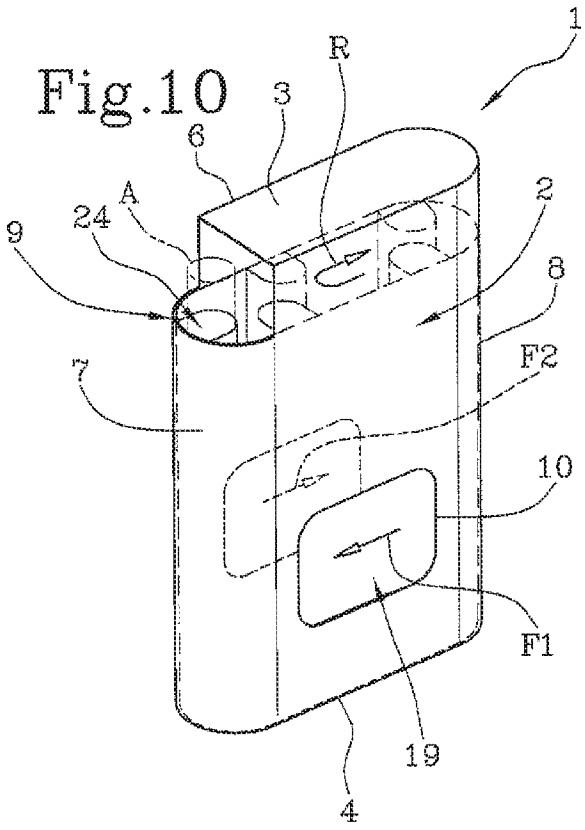
FIGS. 9 and 10 are perspective views showing respective parts of the packet of FIG. 1.

With the packet 1 in the assembled condition, as described in more detail hereinafter in this description, the outer wrapper 2 has at least one opening 10, 11 facing a sidewall 23 of the sleeve 19 at the contact and guide element (the internal drawer 12) to allow applying at least one sliding force F1, F2 on the sleeve 19 and to produce a rotation R of the selfsame sleeve 19 along the aforementioned closed path around the longitudinal axis 20 (FIG. 10).

Preferably, the sleeve 19 is located inside the outer wrapper 2 in such a way that the upper free edge 21 is accessible through the opening 9.

The side wall 23 of the sleeve 19 is made by means of a flexible supporting tape 300 wrapped around the longitudinal axis 20 and defining an inside surface 23*a* facing towards the internal space inside the sleeve 19 and an outside surface 23*b* facing towards the outer wrapper 2 when the sleeve is inserted therein. The shape of the free edges 21, 22 depends on the shape of the internal drawer 12 around which the side wall 23 is wrapped.

The longitudinal dimension of the sleeve 19 measured along the longitudinal axis 20 is greater than the longitudinal dimension of the internal drawer 12 (FIG. 11). In an assembled configuration of the packet 1, the internal drawer 12 rests on the bottom wall 4 of the packet 1 and is axially superposed on the sleeve 19 for a stretch L1 which at least partly covers the openings 10 and 11. Consequently, the sleeve 19 rises above the internal drawer 12 by a stretch L2. The internal drawer 12 constitutes a guide for the sleeve 19 and prevents it from collapsing (as described below) and provides a base for the bar-shaped articles which surmount it and on which they rotate as one with the sleeve 19.

The sleeve 19 has a plurality of elongate cavities 24. Each elongate cavity 24 extends along a longitudinal axis 25 in such a way as to house one elongate article A which can be inserted into and extracted from the elongate cavity 24 along the longitudinal axis 25 thereof. The longitudinal axes 25 of the elongate cavities 24 are parallel to each other and to the longitudinal axis 20 of the sleeve 19.

The elongate cavities 24 are formed in such a way as to project from the side wall 23, towards the inside of the outer wrapper 2, for example by means of a fastening tape 400 applied to the flexible supporting tape 300.

The elongate cavities 24 have an opening 26 which is accessible from the upper free edge 21 of the sleeve 19. Preferably, the elongate cavities 24 have a supporting base 27 positioned at the end opposite the opening 26 and facing towards the inside of the elongate cavity 24 itself. More specifically, the supporting base 27 is made by folding a portion of the fastening tape 400 or of the flexible supporting tape 300.

The sleeve 19 is positioned in the outer wrapper 2 in such a way that the opening 26 of at least one of the elongate cavities 24 is accessible through the opening 9.

The elongate cavities 24 are facing towards the internal space inside the sleeve 19. More specifically, the elongate cavities 24 are formed in such a way as to project from the side wall 23 at the inside surface 23*a*.

The elongate cavities 24 extend along the respective longitudinal axis 25 for a stretch less than or equal to L2. More specifically, the dimension of the fastening tape 400 measured along the longitudinal axis 20 is equal to L2.

Figure 5:
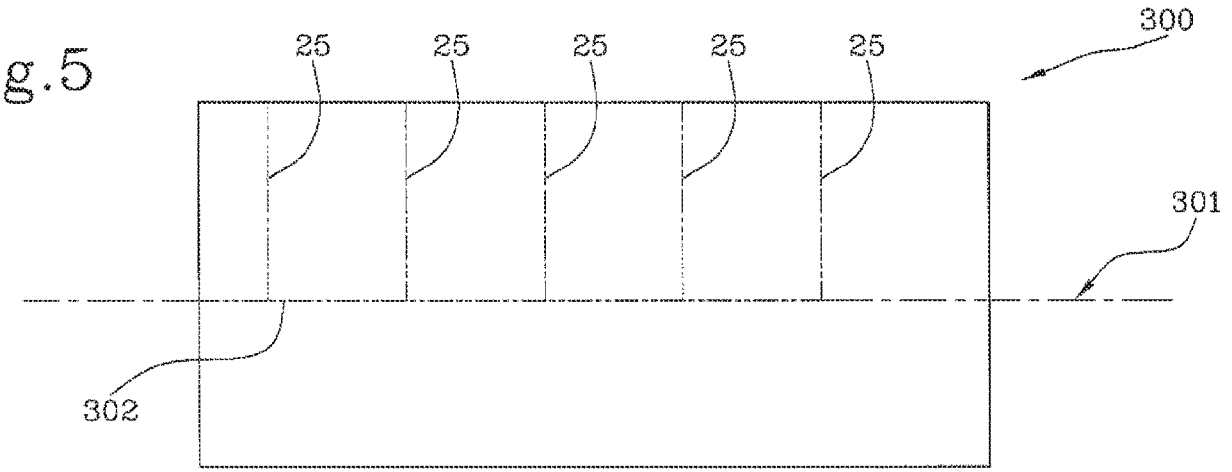
FIGS. 5 and 6 are plan views showing two lengths of sheet material—constituting respective internal components of the packets of FIGS. 1 and 2.
Figure 6:
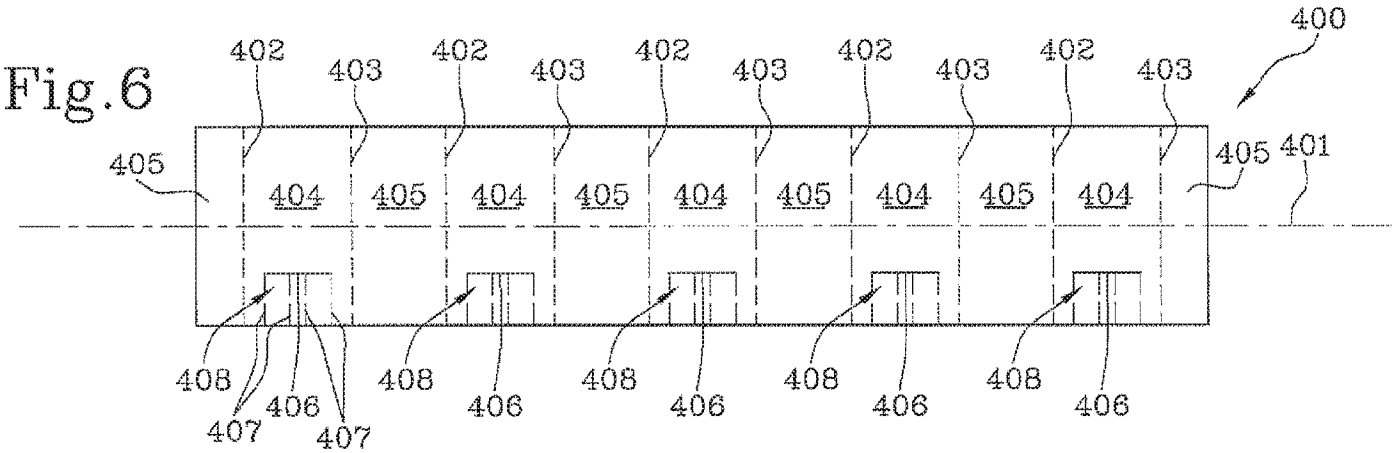

The flexible supporting tape 300 is shown in FIG. 5 and the fastening tape 400 is shown in FIG. 6.

The flexible supporting tape 300 has a substantially elongate rectangular shape and extends along a longitudinal axis 301. FIG. 5 shows the longitudinal axes 25 along which the elongate cavities 24 extend and a perimeter 302 defining the space occupied by the fastening tape 400 on the flexible supporting tape 300.

Figures 7, 8:
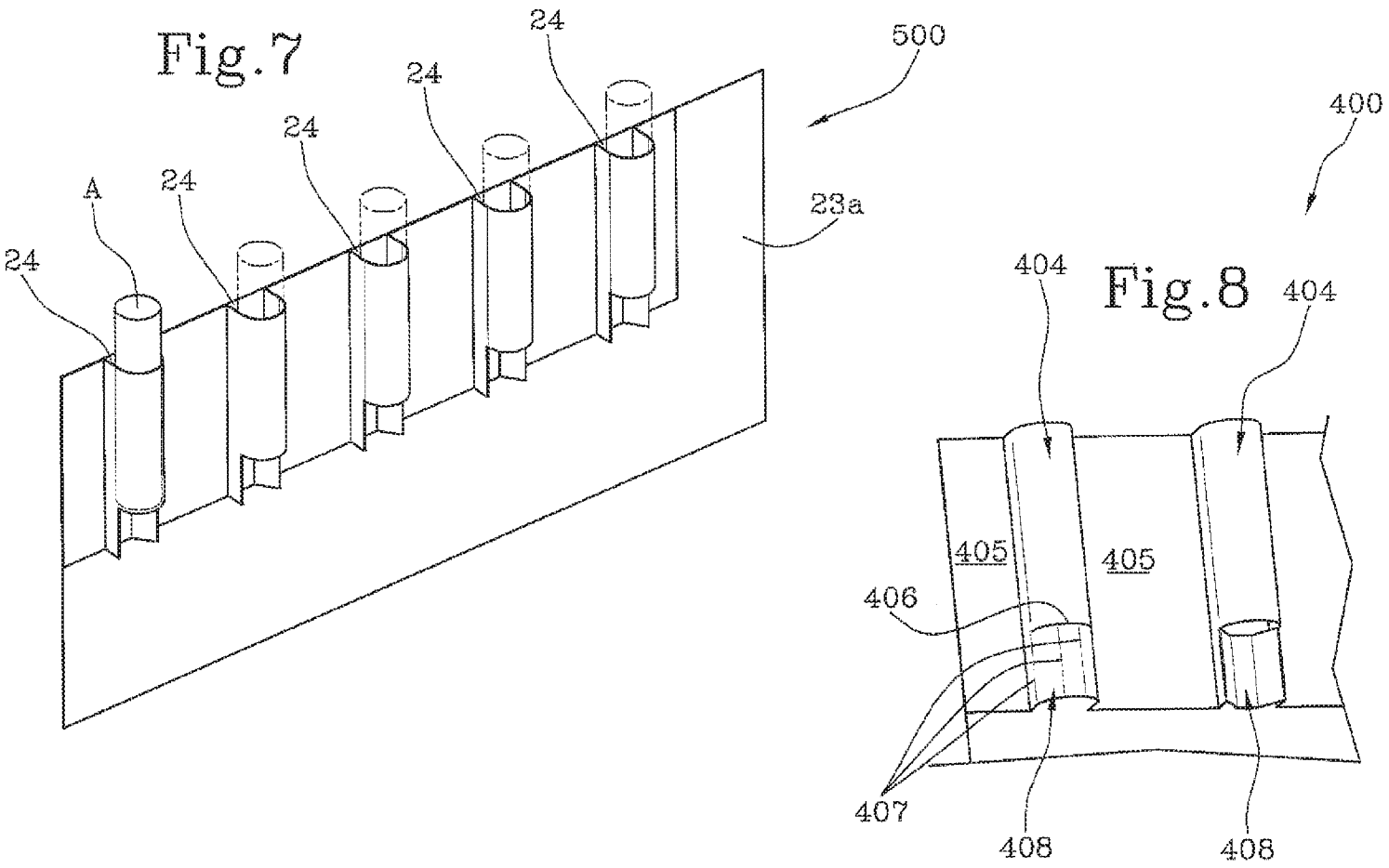
FIGS. 7 and 8 are perspective views in different scales, showing the internal components of the packets of FIGS. 1 and 2 made using the lengths of sheet material of FIGS. 5 and 6.

The fastening tape 400 has a substantially elongate rectangular shape and extends along a longitudinal axis 401. FIG. 6 shows a first set of transverse folding lines of weakness, labelled 402, and a second set of transverse folding lines of weakness, labelled 403, defining alternate panels 404 and 405. Each panel 404, delimited by a transverse folding line of weakness 402 and a transverse folding line of weakness 403, defines an elongate cavity 24 when suitably curved, as illustrated in FIG. 7 or 8. The transverse folding lines of weakness 402 and the transverse folding lines of weakness 403 run perpendicularly to the longitudinal axis 401 and in such a way as to be parallel to the longitudinal axis 25 of the respective elongate cavity 24 in the assembled configuration. Each panel 405 defines a portion for fixing the fastening tape 400 on the flexible supporting tap 300.

For each panel 404, the fastening tape 400 has a cutting line 406 running parallel to the longitudinal axis 401 and perpendicularly to the transverse folding lines of weakness 402 and 403. Each cutting line 406 is located in a central portion of the respective panel 404 relative to the panel dimension which is parallel to the longitudinal axis 401. Further, each cutting line 406 is located in a lower portion of the respective panel 404 relative to the panel dimension which is perpendicular to the longitudinal axis 401.

At least three transverse folding lines of weakness 407 extend perpendicularly to the respective cutting line 406 towards a lower edge of the fastening tape 400. The portion included between the cutting line 406 and the lower edge of the fastening tape 400 defines a flexible strip 408 which can be shaped to form the supporting base 27 in the assembled configuration of the sleeve 19. In an alternative embodiment, the strip 408 is defined between two cutting lines 406 running parallel on the same panel 404.

To make the sleeve 19, the fastening tape 400 is formed into the shape shown in FIGS. 7 and 8 and fixed to the flexible supporting tape 300 at the panels 405. The panels 404 are curved relative to the flexible supporting tape 300 to form the elongate cavities 24 and the panels 405 are parallel to the flexible supporting tape 300 and superposed thereon. The strips 408 are folded in the direction opposite to the curvature of the panels 404 to define the supporting base 27 of the respective elongate cavity 24.

More specifically, FIG. 8 illustrates a detail of the shaped fastening tape 400 in which the two panels 404 illustrated are curved. The strip 408 of the panel 404 on the left still follows the curvature of the respective panel 404, whilst the strip 408 of the panel 404 on the right has already been deformed in the direction opposite to the curvature of the respective panel 404 to define the supporting base 27.

FIG. 7 shows a composite tape 500 formed by shaping the fastening tape 400 and coupling it to the flexible supporting tape 300. Shown in the composite tape 500 are the elongate cavities 24 and the respective bar-shaped articles A housed therein and each resting on the respective supporting base 27. To obtain the sleeve 19, the composite tape 500 is wrapped in such a way that the elongate cavities 24 are facing towards the internal space inside the sleeve itself. In other words, the fastening tape 400 is fixed to the surface of the flexible supporting tape 300 which will form the inside surface 23*a* of the sleeve 19.

Figure 9:
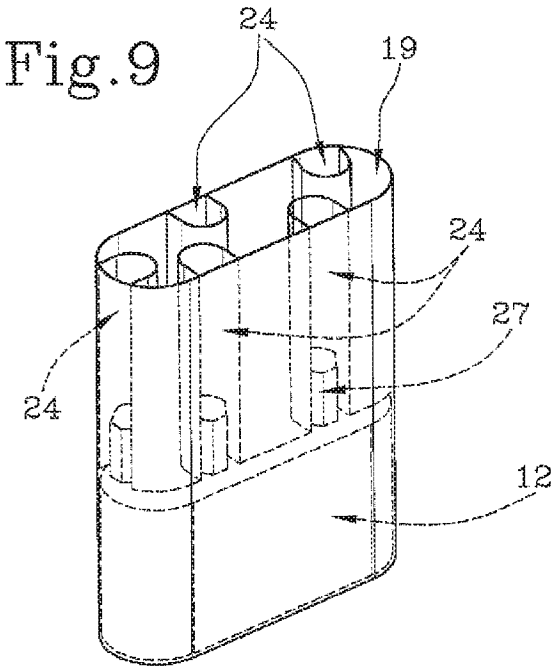

With reference to FIG. 11, the blank 100 is folded and shaped in such a way as to make the outer wrapper 2. With reference to FIGS. 9 and 11, the fastening tape 400 is shaped, coupled to the flexible supporting tape 300 and wrapped therewith around the longitudinal axis 20 to form the sleeve 19. The blank 200 is folded and shaped in such a way as to make the internal drawer 12. The sleeve 19 is fitted on the internal drawer 12 and inserted into the outer wrapper 2. Preferably, the bottom wall 4 of the outer wrapper 2 (or the top wall 3) can be reclosed reversibly (tuck in flap) so that at least the sleeve 19 can be extracted and replaced.

The bar-shaped articles A are inserted axially into the elongate cavities 24.

In an alternative embodiment of the sleeve 19, not illustrated, the supporting bases 27 are absent and the bar-shaped articles A rest directly on the top wall 13 of the internal drawer 12 or on the bottom wall 4 of the outer wrapper 2.

In a further embodiment, not illustrated, the sleeve 19 is made only with the flexible supporting tape 300 where there are two sets of evenly spaced transverse folding lines of weakness similar to the folding lines 402 and 403 of the fastening tape 400 to define the suitably arcuate elongate cavities 24 and where, if necessary, there are parallel indentations and transverse folding lies of weakness similar to the indentations 406 and the folding lines 407 of the fastening tape 400. In this embodiment of the sleeve 19, the bar-shaped articles A are partly in contact with the lateral inside surface of the outer wrapper 2 and slide against it during the rotation R.

FIGS. 1 and 10 illustrate the packet 1 in the assembled condition and showing the outer wrapper 2 with the opening 9 through which one of the bar-shaped articles A housed in one of the elongate cavities 24 protrudes. The user can thus pick the elongate article out of the respective elongate cavity along the longitudinal axis 25. To take out another elongate article, the user place his fingers (more specifically, thumb and index finger) on the outside surface 23*b* of the sleeve 19 at the openings 10 and 11, respectively, and causes the sleeve 19 to slide around the internal drawer 12. More specifically, the user applies opposite sliding forces F1 and F2 at the two windows 10 and 11, respectively, in such a way as to produce a rotation R of the sleeve 19 which is positioned between the internal drawer 12 and the outer wrapper 2, as shown in FIG. 10.

Alternatively, only one of the two windows 10, 11 is present and the user applies only one sliding force.

The internal drawer 12 constitutes a support and guide element for the sleeve 19, preventing it from collapsing inwards after the user has taken out an article. In other words, the internal drawer 12 is structured to support the sleeve 19 and to guide its sliding movement to make an elongate article available at the opening 9.

The internal drawer 12 may be provided with a further internal reinforcement collar, not illustrated.

In the embodiment proposed, the internal drawer 12 can be obtained preferably by wrapping the blank 200 around a mandrel. Forming around a mandrel is the technique which best guarantees a cross sectional shape which allows correct guiding and sliding of the sleeve 19.

Figure 2:
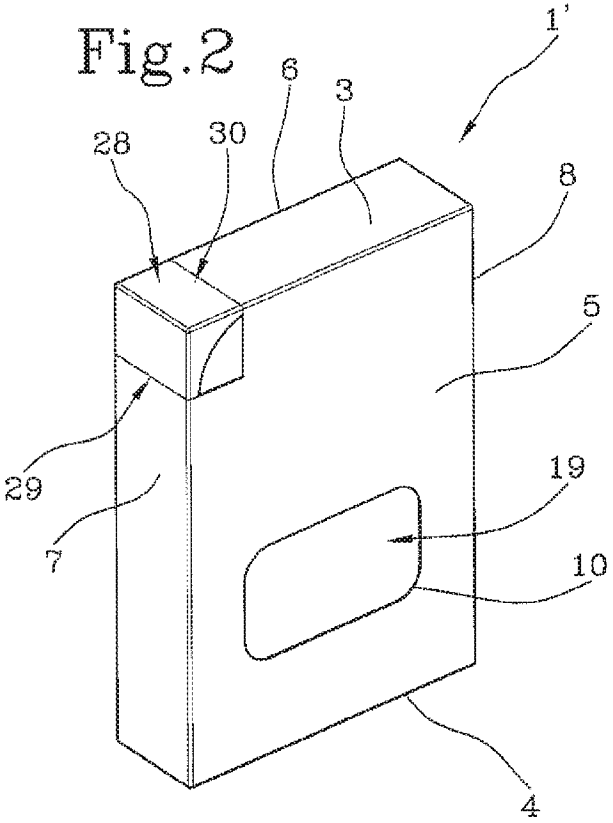
FIGS. 1 and 2 are perspective views of two different embodiments of a packets made according to this invention.
Figure 13:
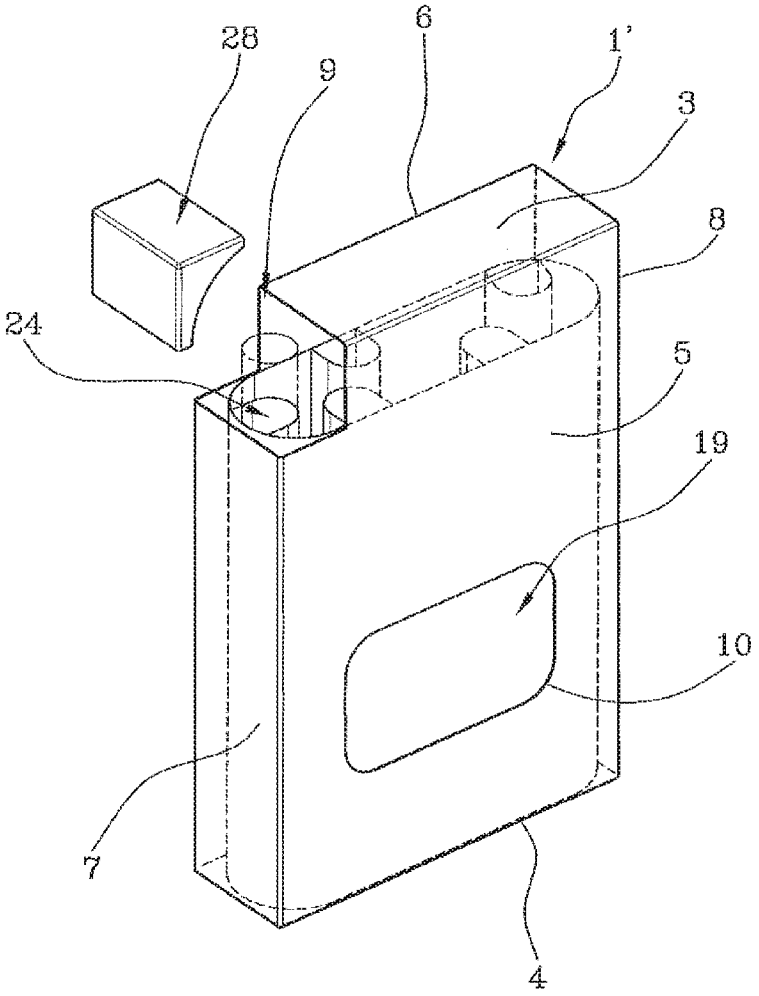
FIG. 13 is a perspective view of the packet of FIG. 2 with some of the internal components shown.

FIG. 2 and FIG. 13 show a different embodiment of the packet 1 where the items in common with the embodiment illustrated in FIG. 1 are denoted by the same reference numerals. The packet 1' differs from the packet 1 in the shape of the outer wrapper 2 which has a longitudinal front band 5 and a longitudinal rear band 6, which are parallel to each other and substantially flat, and two longitudinal side bands 7, 8, which are parallel and substantially flat and which join the front band 5 and the rear band 6 to each other. Further, the opening 9 is initially closed by a corner portion 28 comprising a part of the top wall 3 and of the side band 7 below it, joined to the rest of the outer wrapper 2 by tearable lines of weakness 29 and 30 that can be torn when the packet 1' is opened for the first time.

Figure 12:
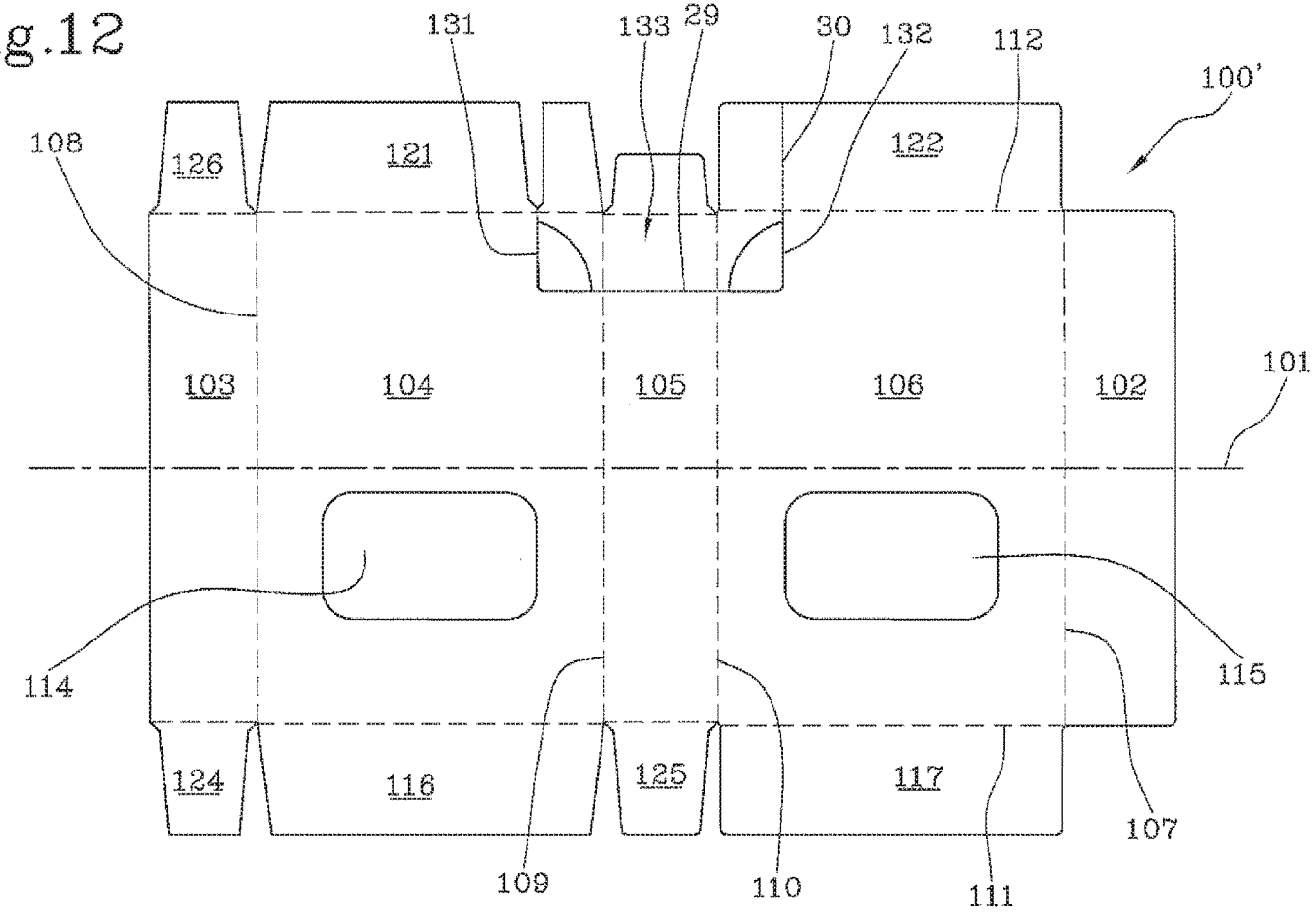
FIG. 12 is a plan view of a blank which can be used to make the packet of FIG. 2.

FIG. 12 shows in a plan view a blank 100' used to make the embodiment of the packet 1' of FIG. 2 where the items which are structurally and functionally in common with the embodiment of the blank 100 illustrated in FIG. 3 are denoted by the same reference numerals.

The blank 100' has a substantially elongate, rectangular shape, extends along a longitudinal axis 101 and has five, substantially rectangular transverse walls, labelled 103, 104, 105, 106 and 102, joined to each other in pairs, from left to right, by lines which are perpendicular to the axis 101 and which are respectively labelled 108, 109, 110, and 107.

The blank 100' is also provided with two transverse folding lines of weakness, labelled 111 and 112, respectively, in a top and bottom zone of it in FIG. 12.

In the zones at the bottom of the walls 104 and 106 in FIG. 12, there are respective openings 114 and 115 which are substantially rectangular in shape and whose sides are parallel to the respective sides of the walls 104 and 106 themselves.

Two panels 116 and 117 are respectively connected to the portions of the line of weakness 111 which delimit the bottoms of the walls 104 and 106.

Two further panels 121 and 122 are respectively connected to the portions of the line of weakness 112 which delimit the tops of the walls 104 and 106. The shape of the panels 121 and 122 and their position relative to the line of weakness 112 substantially reflect the shape and position of the panels 116 and 117 relative to the line of weakness 111.

Alternated with the panels 116 and 117 there are respective tabs 124, 125 connected to the walls 103 and 105, respectively. A tab 126 is connected to the portion of the line of weakness 112 which delimits the top of the wall 103. In the direction perpendicular to the axis 101, the wall 105 is shorter than the wall 103 and extends between the line of weakness 111 and a tearable line of weakness 29. The walls 104 and 106 have a cutaway corner separable along a respective cutting line 131, 132 (for example shaped like the perimeter of a quarter of a circle) which partly extends the line of weakness 29. A panel 133 is positioned between the panels 121, 122 and the walls 104, 105 and 106. The panel 133 is connected to the wall 105 by a tear line of weakness 29 and to the panel 122 by a tearable line of weakness 30. Running along the panel 133 are the lines 109 and 110 perpendicular to the axis 101 and the transverse folding line of weakness 112. The panel 133 is configured to make, in the assembled packet 1', the portion 28 which comprises a part of the top wall 3 and of the side band 7 below it.

In passing from the blank 100' to the outer wrapper 2, the wall 106 corresponds to the longitudinal front band 5 and the wall 104 corresponds to the longitudinal rear band 6. The openings 115 and 114 of the blank 100 thus define the openings 10 and 11 of the outer wrapper 2. The walls 103 and 105 define the two opposite longitudinal bands 7 and 8, respectively. The wall 102 is a connecting wall which, in the outer wrapper, is superposed on the wall 103.

The panels 116 and 117, in conjunction with the tabs 124 and 125, define the bottom wall 4 of the outer wrapper 2, while the panels 121 and 122, in conjunction with the tab 126, define the top wall 3 of the outer wrapper 2. The panel 133 defines the portion 28 and closes the upper opening 9 of the outer wrapper 2.

The packet according to this invention achieves the preset aims in that it prevents the articles from falling out accidentally and keeps them in the vertical position which makes it easier for them to be taken out. The articles are also kept separate and spaced from each other, thus avoiding damage caused by uncontrolled movements and knocking against each other.

These aims are achieved by assembling the outer wrapper 2, the sleeve 19 and the contact and guide element (internal drawer 12).

Furthermore, by directing the bar-shaped articles A towards the internal space inside the supporting sleeve 19, it is possible to keep the surface of the sleeve smooth on the outside in order to create a pushing surface. Further, a minimum dimension (thickness) of the internal drawer 12 is required to house the protruding parts of the articles so that they can slide without knocking against each other when the sleeve 19 is moved. Moreover, it allows minimizing the spacing between the articles to guarantee rotation around the rounded ends of the internal drawer without adjacent articles touching each other.

The invention claimed is:

1. A packet for bar-shaped articles comprising an outer wrapper defining an internal space for housing the bar-shaped articles and including an access opening for accessing the bar-shaped articles, a sleeve located inside the outer wrapper and configured to support the bar-shaped articles positioned with their longitudinal axes parallel to a longitudinal axis of the sleeve and to move the bar-shaped articles inside the outer wrapper along a closed path running transversely to the longitudinal axis, the closed path being configured to make at least one of the bar-shaped articles accessible through the access opening, wherein the outer wrapper includes a window facing a sidewall of the sleeve, the sleeve including a plurality of elongate cavities, each of the plurality of elongate cavities extending along a respective longitudinal axis to house one of the bar-shaped articles which is slidably insertable into and extractable from the each of the plurality of elongate cavities along the respective longitudinal axis, wherein the longitudinal axes of the plurality of elongate cavities are parallel to each other and to the longitudinal axis of the sleeve, wherein the plurality of elongate cavities project from an internal surface of a side wall of the sleeve towards an internal space of the sleeve, an internal drawer inserted in the sleeve and provided at the window to allow application of a sliding force on the sleeve to produce a rotation of the sleeve along the closed path.

2. The packet according to claim 1, wherein an upper free edge of the sleeve is accessible through the access opening.

3. The packet according to claim 1, wherein the sleeve is wrapped around an outside of the internal drawer.

4. The packet according to claim 3, wherein the internal drawer includes rounded vertical edges and a longitudinal dimension of the sleeve measured along the longitudinal axis of the sleeve is greater than a corresponding longitudinal dimension of the internal drawer.

5. The packet according to claim 1, wherein in an assembled configuration of the packet, the internal drawer rests on a bottom wall of the packet and axially overlaps the sleeve for a first stretch which at least partly covers the window and the sleeve rises above the internal drawer for a second stretch.

6. The packet according to claim 1, wherein the side wall includes a flexible supporting tape wrapped around the longitudinal axis and defining the internal surface facing towards the internal space inside the sleeve and an outside surface facing towards the outer wrapper when the sleeve is inserted in the outer wrapper.

7. The packet according to claim 1, wherein the sleeve includes a fastening tape applied to a flexible supporting tape, the flexible supporting tape forming the side wall of the sleeve, and wherein the plurality of elongate cavities project from the side wall via the fastening tape, the plurality of elongate cavities each having an opening accessible from a free upper edge of the sleeve.

8. The packet according to claim 1, wherein each of the plurality of elongate cavities includes a supporting base at an end opposite to an opening of the elongate cavity and facing towards an inside of the elongate cavity.

9. The packet according to claim 5, wherein the plurality of elongate cavities extend along a respective longitudinal axis for a stretch that is smaller than or equal to the second stretch.

10. The packet according to claim 5, wherein the sleeve includes a fastening tape applied to a flexible supporting tape to form the plurality of elongate cavities and one dimension of the fastening tape, measured along the longitudinal axis of the sleeve is equal to the second stretch.

11. The packet according to claim 8, wherein the supporting base is made by a folded portion of a fastening tape or of a flexible supporting tape.

12. The packet according to claim 1, wherein the plurality of elongate cavities are positioned entirely above the internal drawer.

13. The packet according to claim 1, wherein the plurality of elongate cavities are positioned to have no overlap with the internal drawer along the longitudinal axis of the sleeve.

* * * * *